US006766797B1

(12) United States Patent
Lavigne et al.

(10) Patent No.: US 6,766,797 B1
(45) Date of Patent: Jul. 27, 2004

(54) METHOD FOR MAKING A DISPOSABLE PACKAGE FOR AN AGENT ACTIVATABLE SUBSTANCE AND A PACKAGE MADE THEREBY

(75) Inventors: Peter Lavigne, Shrewsbury, MA (US); Lauren Milch, Mandon, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/410,959

(22) Filed: Apr. 10, 2003

(51) Int. Cl.[7] ..... F24J 1/00

(52) U.S. Cl. ..... 126/263.05; 126/263.08; 126/263.09

(58) Field of Search ..... 126/263.01, 263.05, 126/263.06, 263.07, 263.08, 263.09, 262; 62/4; 426/109, 113, 114; 44/251, 252, 253, 250

(56) References Cited

U.S. PATENT DOCUMENTS

| | | | | | |
|---|---|---|---|---|---|
| 858,848 | A | * | 7/1907 | Allison | 126/263.05 |
| 1,525,168 | A | * | 2/1925 | Davidson | 44/251 |
| 1,613,120 | A | * | 1/1927 | O'Neal et al. | 44/252 |
| 1,819,807 | A | * | 8/1931 | Baysinger | 44/253 |
| 3,903,011 | A | * | 9/1975 | Donnelly | 516/107 |
| 3,980,070 | A | * | 9/1976 | Krupa | 126/263.05 |
| 4,522,190 | A | | 6/1985 | Kuhn et al. | |
| 4,967,573 | A | | 11/1990 | Wilhelm | |
| 5,117,809 | A | | 6/1992 | Scaringe et al. | |
| 5,295,475 | A | | 3/1994 | Kaneko | |
| 5,390,659 | A | | 2/1995 | Scaringe et al. | |
| 5,517,981 | A | | 5/1996 | Taub et al. | |
| 5,611,329 | A | | 3/1997 | Lamensdorf | |
| 5,935,486 | A | | 8/1999 | Bell et al. | |
| 5,984,953 | A | | 11/1999 | Sabin et al. | |
| 6,099,555 | A | | 8/2000 | Sabin | |
| 6,116,231 | A | | 9/2000 | Sabin et al. | |
| 6,601,403 | B1 | * | 8/2003 | Roth et al. | 62/457.2 |

* cited by examiner

*Primary Examiner*—James C. Yeung
(74) *Attorney, Agent, or Firm*—Vincent J. Ranucci

(57) ABSTRACT

A method for making a disposable package for an agent, typically water, activatable substance includes providing a planar support member of a moisture and air barrier material, mounting on the support member a sheet at least in part translucent, sealing all but one edge of the sheet to the support member to provide a pocket fixed to the support member, placing the agent activatable substance in the pocket so as to occupy only a portion of the pocket, folding the support member and pocket upon themselves, and releasably sealing overlying portions of the support member together along all but a folded edge of the support member, to enclose the agent activatable substance, whereby to provide a package which is openable by separating the overlying portions to expose the pocket for introduction of the agent into the pocket to activate the agent activatable substance therein.

15 Claims, 2 Drawing Sheets

METHOD FOR MAKING A DISPOSABLE PACKAGE FOR AN AGENT ACTIVATABLE SUBSTANCE AND A PACKAGE MADE THEREBY

The invention described herein may be manufactured and used by the U.S. Government for governmental purposes without the payment of any royalty thereon.

BACKGROUND OF THE INVENTION

1. Field of the Invention

The invention relates to disposable packages and methods for making same, and is directed more particularly to a method for making a package for a substance activatable by an activating agent, typically water, and the package made thereby.

2. Description of the Prior Art

Disposable packages for water activatable substances are generally known. A number of such packages are referred to as "flameless heaters" and are provided with substances which, upon contact with water, produce heat, for warming the hands of a person, or for warming a food tray, or the like. Examples of such devices may be found in U.S. Pat. No. 5,390,659, issued Feb. 21, 1995, U.S. Pat. No. 4,522,190, issued Jun. 11, 1985, U.S. Pat. No. 5,517,981, issued May 21, 1996, U.S. Pat. No. 5,935,486, issued Aug. 10, 1999, and U.S. Pat. No. 5,611,329, issued Mar. 18, 1997. Inasmuch as such packages are used only once and disposed of, there is needed a package which is very inexpensively produced, easily used, and adds function to the activatable substance.

In some packages the activating agent and the exothermic heating agent are both packaged, but segregated from each other by a barrier, with a means to break the barrier to allow the active agent to mix with the heating agent. Such packages are necessarily relatively complex and expensive to make.

In other packages, the activating agent, usually water, is added to the package from an outside source. The '659 patent is of the latter sort and includes structure for receiving and metering water. The additional structure adds costs to the manufacture of the package and results in an awkward configuration of package.

Still other packages require a tool or implement to open or alter the package to introduce water or other activating agent to the heat generating agent.

Accordingly, there is a need for a very simple package which is inexpensive to manufacture, easy to use without any implements, and which indicates very inexpensively how much activating agent to add to the activatable substance, such as an exothermic chemical heater, and which adds function to the activatable substance.

There is further a need for a functional disposable package for sealingly retaining and preserving an activatable substance and for providing means by which an activating agent can be added to the substance in the package. For moisture sensitive substances, a high-moisture-barrier package is needed. Such packages require the use of opaque high-barrier materials which are hermetically sealed to provide extended shelf-life characteristics.

There is similarly needed a method by which this integrated functional package can be easily and inexpensively made.

SUMMARY OF THE INVENTION

An object of the invention is accordingly to provide an inexpensive, easy to use, disposable package for sealingly retaining an agent activatable substance, such as an exothermic chemical heater, the agent being, for example, water, and having facility for admitting a measured amount of agent into the same package to contact the substance at the time of use. A principal feature of the invention is the dual-purpose utility of the package that eliminates the need for an additional package or secondary materials that serve both the storage requirements for a high-barrier package and the operational requirements for measuring and delivering an actuating agent to the package upon use. A principal benefit of the invention is the reduced size, weight, and ease of use characteristics provided by the integrated functional configuration.

A further object of the invention is to provide a method for making such a package.

With the above and other objects in view, a feature of the present invention is the provision of a method for making a disposable package for an agent activatable substance. The method comprises the steps of providing a substantially planar support member of a moisture and air barrier material, mounting on a major surface of the support member a sheet at least in part translucent, the sheet being mounted within all boundaries of the support member surface, sealing all but one edge of the sheet to the support member to provide a pocket fixed to the support member, placing the agent activatable substance in the pocket so as to occupy only a portion of the pocket, folding the support member and pocket upon themselves, and releasably sealing overlying portions of the support member together along all but a folded edge of the support member to enclose the agent activatable substance. There is thereby provided a method for making a hermetically sealed package which is openable by separating the overlying portions to expose the pocket for introduction of an agent into the pocket to activate the agent activatable substance therein.

In accordance with a further feature of the invention, there is provided a disposable package for an agent activatable substance. The package comprises a substantially planar support member of a moisture and air barrier material, a pocket of material, at least in part translucent, mounted on the support member, the pocket being open along one side thereof, an agent activatable substance disposed in the pocket and occupying only a portion of the pocket, the support member and the pocket being folded upon themselves, the support member being releasably sealed along all overlying edge portions other than a folded edge. There is thus provided a package which is readily openable without the use of a cutting implement by separating the overlying releasably sealed edge portions to expose the pocket open side for introduction of an agent into the pocket for activating the agent activatable substance, and thereby not compromising the integrity of the pocket.

The above and other features of the invention, including various novel details of construction, function and combinations of method steps and parts, will now be more particularly described with reference to the accompanying drawings and pointed out in the claims. It will be understood that the particular method and device embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 2:
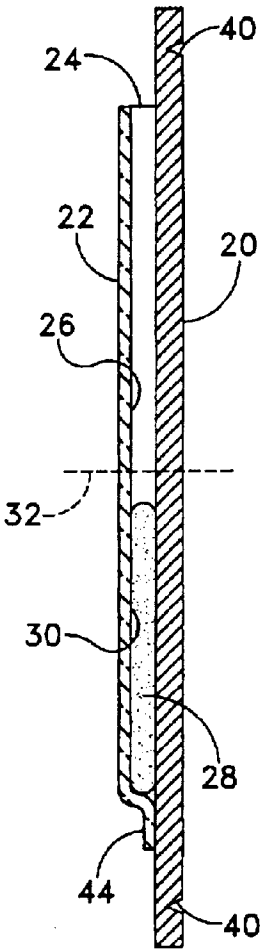
FIG. 2 is a sectional view taken along line II—II of FIG. 1.
Figure 1:
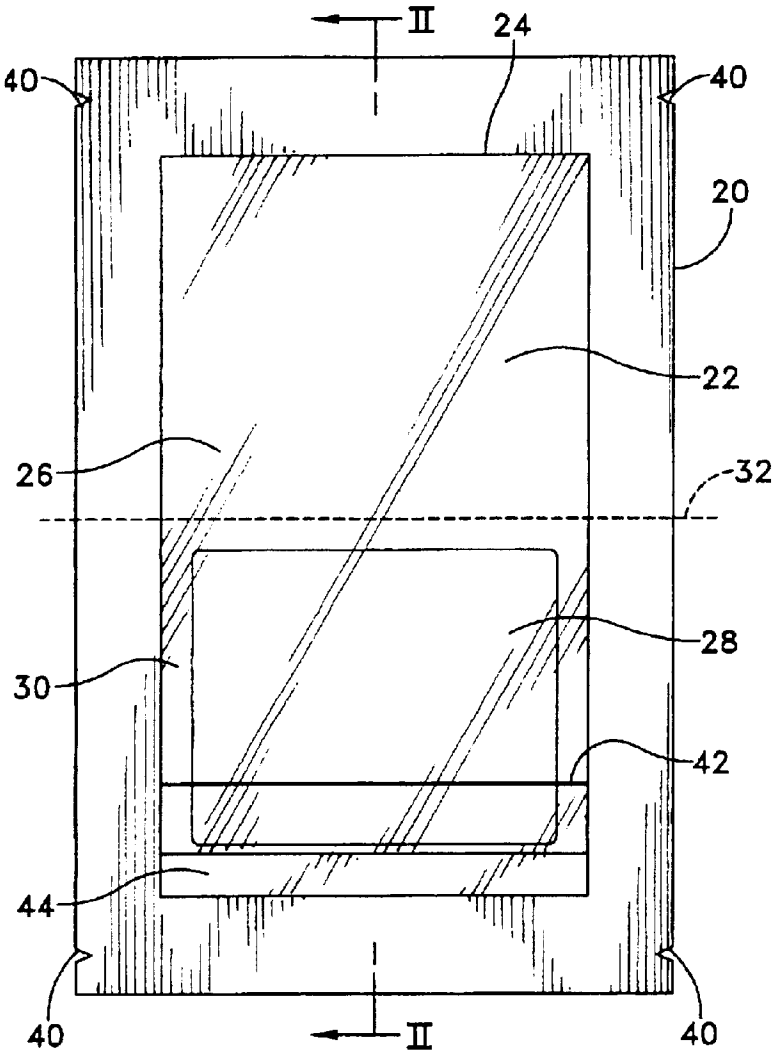
FIG. 1 is a front elevational view of one form of package illustrative of an embodiment of the invention.

Referring to FIGS. 1 and 2, it will be seen that in accordance with the inventive method, there is provided a substantially planar support member 20 which is of an opaque high-barrier material, such as a high-barrier metal foil laminate, constituting a moisture and air barrier.

A sheet 22 of a plastics material, or the like, is mounted on the support member 20. The sheet 22 preferably is wholly, or at least partially, translucent, such that labeling and/or directions may be placed on at least one of the support member 20 and the sheet 22, and read by a user of the package. Some translucence is necessary to see the activating agent. The sheet 22 is mounted within the boundaries of the support member 20, typically by at least ½ inch.

The sheet 22 is sealed to the support member 20 along all but one edge 24 thereof, to provide a pocket 26 fixed to the support member 20 and open at the edge 24 thereof.

The support member 20 may be, for example, about 16 by 6 inches, and the pocket about 5 by 12 inches.

An agent activatable substance 28, typically water, is then placed in the pocket 26. The substance 28 occupies only a portion 30 of the pocket 26 which is disposed beneath a hypothetical line 32 extended widthwise of the package at a mid-point of the length of the package.

The water activatable substance 28 can be, for example, a chemical heater substance which, upon wetting, warms up. In another application, the substance 28 can be a dehydrated foodstuff.

Figure 4:
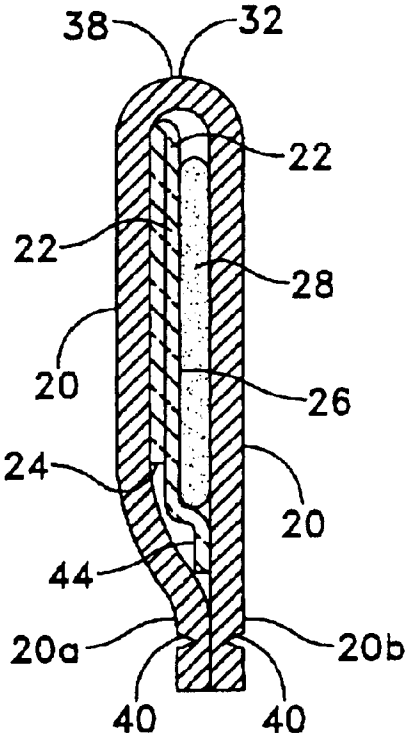
FIG. 4 is a sectional view taken along line IV—IV of FIG. 3.
Figure 3:
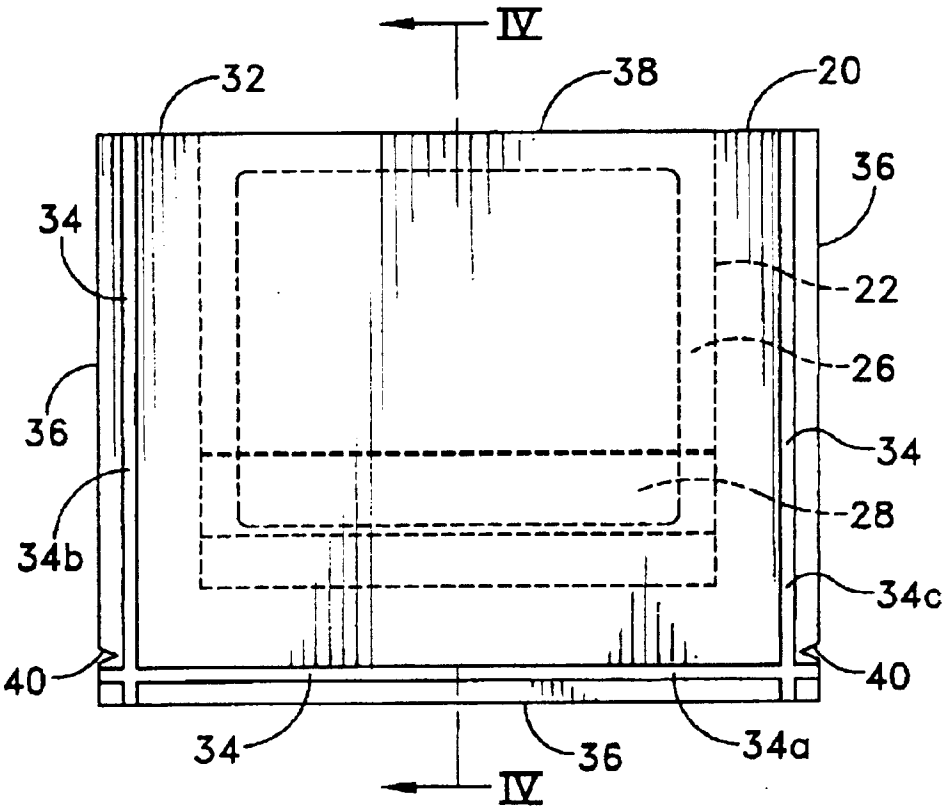
FIG. 3 is a front elevational view of the package of FIGS. 1 and 2, illustrative of a step in the method for making the package.

The support member 20 and the pocket 26 are then folded at line 32 upon themselves, as illustrated in FIGS. 3 and 4. If the support member and pocket are dimensioned as set forth above, the folded-over package is about 6×8 inches.

The overlying portions 20*a*, 20*b* (FIG. 4) are then releasably and hermetically sealed together along lines 34 (FIG. 3) close to and parallel to the non-fold edges 36. No sealing is applied to the fold edge 38. However, the linear seals 34 and the fold edge 38 serve to completely and hermetically enclose the substance 28.

Preferably, the support member 20 is provided with tear notches 40 which permit the overlying layers 20*a*, 20*b* of the support member to be separated just inside a seal line 34*a*, but well spaced from a pocket bottom seal 44.

The package shown in FIGS. 3 and 4 is easily bulk packaged, transported, distributed, and carried until needed for use. The package is robust and because the package is hermetically sealed and provides a barrier to moisture, and because the water activatable material usually is in dry powder form, the package and contents exhibit an extended shelf life.

To use the package, an operator effects a tear from one tear notch 40 to the other, opening one end of the folded over support member 20. The two halves of the support member are then pulled apart, the line seals 34*b*, 34*c* releasing to permit returning the support member 20 to the configuration shown in FIGS. 1 and 2.

Water may be admitted to the pocket 26 by way of the pocket open end 24, such that the water (not shown) contacts the substance 28. Preferably, the sheet 22 is provided with a line 42 indicating the appropriate level to which water should be admitted. The location of the line 42 will vary with the type of substance 28 disposed in the pocket 26.

After use, the package may be discarded.

There is thus provided a disposable package for sealingly retaining an agent activatable substance, the package having facility for admitting the agent into the package to contact and activate the substance. There is further provided a method for making such a package easily and economically.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A method for making a disposable package for an agent activatable substance, the method comprising the steps of:

providing a substantially planar support member of a moisture and air barrier material;

mounting on a major surface of the support member a sheet at least in part translucent, the sheet being mounted within all boundaries of the support member surface;

sealing all but one edge of the sheet to the support member to provide a pocket fixed to the support member;

placing the agent activatable substance in the pocket so as to occupy only a portion of the pocket;

folding the support member and pocket upon themselves; and releasably sealing overlying portions of the support member together along all but a folded edge of the support member to enclose the agent activatable substance;

whereby to provide a package which is openable by separating the overlying portions to expose the pocket for introduction of an activating agent into the pocket to activate the agent activatable substance therein, wherein the step of providing the support member comprises providing a foil-based, opaque support member, and wherein the step of sealing the sheet edges to the support member comprises heat such that the sheet is hermetically sealed to the support member.

2. The method in accordance with claim 1 wherein the agent is a fluid.

3. The method in accordance with claim 1 wherein the agent is water.

4. The method in accordance with claim 1 wherein the support member is an opaque, high-barrier polymer.

5. The method in accordance with claim 1 wherein at least one of the support member and the sheet of the pocket is provided with activating agent fill level indicia thereon and observable to an operator.

6. A disposable package for an agent activatable substance, the package comprising:

a substantially planar support member of a moisture and air barrier material;

a sheet of material, at least in part translucent, mounted on the support member for forming a pocket, the pocket being open along one side thereof;

an agent activatable substance disposed in the pocket and occupying only a portion of the pocket;

said support member and the pocket being folded upon themselves, said support member being releasably sealed along all overlying edge portions, other than a folded edge;

whereby to provide a package which is openable by separating the overlying releasably sealed edge portions to expose the pocket open side for introduction of an activating agent into the pocket for activating said agent activatable substance, and wherein the pocket is hermetically sealed to said support member and said support member is hermetically sealed to itself along the overlying edges thereof, other than the folded edge.

7. The package in accordance with claim 6 wherein said support member comprises a flexible foil-based support member.

8. The package in accordance with claim 7 wherein said foil-based support member is opaque.

9. The package in accordance with claim 7 wherein said support member is provided with notches which facilitate tearing of said support member along a line substantially parallel to and spaced from a bottom of the pocket.

10. The package in accordance with claim 9 wherein the notches facilitate the tearing to render the package openable by the separating of opposite overlying sealed edge portion of the package, such that the package is openable without use of a cutting device and without compromising integrity of the package.

11. The package in accordance with claim 6 wherein at least one of said support member and said sheet of the pocket is provided with an agent fill level indicia thereon and observable to a user.

12. The package in accordance with claim 11 wherein the agent fill indicia are disposed on said support member and observable through translucent portions of the pocket.

13. The package in accordance with claim 6 wherein said agent is a fluid.

14. The package in accordance with claim 6 wherein said agent is water.

15. The package in accordance with claim 6, wherein said support member is an opaque, high-barrier polymer.

* * * * *